US006167619B1

(12) United States Patent
Beagle

(10) Patent No.: US 6,167,619 B1
(45) Date of Patent: Jan. 2, 2001

(54) METHOD FOR ASSEMBLING A HEAT EXCHANGER

(75) Inventor: Gerald R. Beagle, Blissfield, MI (US)

(73) Assignee: Blissfield Manufacturing Company, Blissfield, MI (US)

( * ) Notice: Under 35 U.S.C. 154(b), the term of this patent shall be extended for 0 days.

(21) Appl. No.: 09/192,028

(22) Filed: Nov. 13, 1998

Related U.S. Application Data

(60) Provisional application No. 60/066,776, filed on Nov. 15, 1997.

(51) Int. Cl.[7] ..... B23P 15/26

(52) U.S. Cl. ..... 29/890.043; 29/890.047; 29/727

(58) Field of Search ..... 29/890.043, 890.047, 29/726, 727, 52.3

(56) References Cited

U.S. PATENT DOCUMENTS

| | | | | |
|---|---|---|---|---|
| 3,466,738 | | 9/1969 | Mount | 29/525 |
| 4,302,874 | | 12/1981 | Colas | 29/426.6 |
| 4,531,577 | | 7/1985 | Humpolik et al. | 165/150 |
| 4,541,655 | | 9/1985 | Hunter | 285/55 |
| 4,625,378 | | 12/1986 | Tanno et al. | 29/157.3 |
| 4,645,247 | | 2/1987 | Ward | 285/382.1 |
| 4,769,897 | | 9/1988 | Moseman | 29/525 |
| 4,839,950 | | 6/1989 | Stroup | 29/157.3 |
| 4,858,296 | | 8/1989 | Gray | 29/157.3 |
| 5,154,679 | * | 10/1992 | Fuller et al. | 29/890.043 |
| 5,158,134 | * | 10/1992 | Mongia et al. | 29/890.043 |
| 5,484,174 | | 1/1996 | Gotoh et al. | 285/382.2 |
| 5,511,831 | | 4/1996 | Barton | 285/382 |
| 5,680,695 | * | 10/1997 | Vetter | 29/727 |
| 5,687,473 | * | 11/1997 | Tokura | 29/727 |

FOREIGN PATENT DOCUMENTS

| | | | |
|---|---|---|---|
| 4334230A1 | 1/1995 | (DE) | 39/4 |
| 2232370 | 12/1990 | (GB) | 53/8 |

OTHER PUBLICATIONS

P.W. Atkins, *Physical Chemistry*, Third Edition (1986), pp. 770–772, 784–785.

* cited by examiner

*Primary Examiner*—I Cuda Rosenbaum
(74) *Attorney, Agent, or Firm*—Gary M. Hartman; Domenica N. S. Hartman

(57) ABSTRACT

A method of assembling a heat exchanger unit (12) that involves an expansion technique for securing a heat exchanger tube (18) to a number of fins (24) without physical intrusion into the tube passage. The method includes forming the tube (18) to have substantially parallel tube portions (26). Pairs of tubes portions (26) may be connected by a bend or an elbow (28) to yield a serpentine tube configuration. Each of the fins (24) is formed to include one or more apertures that are sized to receive the tube portions (26). The fins (24) are then arranged to form a fin pack (22), so that their apertures are aligned to form an aggregate passage through the fin pack (22). The tube portions (26) are then inserted into the aggregate passage, such that the elbow (28) (if present) and/or the ends of the tube (18) remain outside the fin pack (22). Finally, the tube portions (26) are expanded to contact and become mechanically secured to the fins (24) through the application of a compressive force in a longitudinal direction to the tube portions (26).

13 Claims, 3 Drawing Sheets

METHOD FOR ASSEMBLING A HEAT EXCHANGER

CROSS REFERENCE TO RELATED APPLICATIONS

This application claims the benefit of U.S. Provisional Application No. 60/066,776, filed Nov. 15, 1997.

BACKGROUND OF THE INVENTION

1. Field of the Invention

The present invention relates to an improved method for joining tubes to an array of fins for the purpose of assembling a heat exchanger. More particularly, this invention relates to an improved method for mechanically joining tubes and fins, in which a tube is deformed by longitudinal compression without intrusion into the tube passage, causing the tube to expand radially outward to engage the fins and any other hardware to be mounted to the tube.

2. Description of the Prior Art

Heat exchangers are widely used in various industries in the form of radiators for cooling motors, engines, and steering, transmission and hydraulic fluids, condensers and evaporators for use in air conditioning systems, and heaters. In their most simple form, heat exchangers include one or more passages through which a fluid flows while exchanging heat with the environment surrounding the passage. In order to efficiently maximize the amount of surface area available for transferring heat between the environment and fluid, the design of a heat exchanger is typically of a tube-and-fin type containing a number of tubes that thermally communicate with fins. The fins enhance the ability of the heat exchanger to transfer heat from the fluid to the environment, or vice versa. Various heat exchanger designs are known in the prior art. Design variations include the manner in which the fluid passage is constructed and the type of fin used. For example, the passage may be composed of one or more serpentine tubes that traverse the heat exchanger in a circuitous manner, or a number of discrete parallel tubes joined, typically brazed, to and between a pair of headers. The fins may be provided in the form of panels having apertures through which the tubes are inserted, or in the form of centers that can be positioned between adjacent pairs of tubes.

Conventionally, heat exchangers are manufactured by joining the tubes and fins using a brazing operation or a mechanical expansion technique. Mechanical expansion techniques rely solely on the mechanical joining of the components of the heat exchanger to ensure the integrity of the heat exchanger. Advantages of mechanical expansion techniques include good mechanical strength and avoidance of joining operations that require a furnace operation. The thermal performance of mechanically joined tubes and fins relies on adequate contact between the tubes and fins. Accordingly, improvements in mechanical expansion techniques have often been directed to ways in which the uniformity and integrity of the tube-to-fin joint can be improved. Conventional mechanical expansion methods can generally be categorized as being external or internal operations. Internal expansion techniques typically entail forcing an expansion tool, such as a mandrel or bullet, into the tubes, or by applying hydraulic internal pressure to the tubes. These methods physically force the walls of the tubes outward and into engagement with the fins. In contrast, external expansion techniques have generally entailed deforming the tubes with a tool that impacts or presses the tubes into engagement with the fins. While internal expansion methods tend to be characterized by enhanced joint strength and a lower resistance to heat transfer, the intrusion of a tool or fluid into the tubes is generally undesirable from the standpoint of the potential for introducing contaminants into the tubes, necessitating post-forming cleaning operations. Furthermore, prior art methods for deforming a tube wall raise the potential for excessive wall thinning, and therefore reduced strength. Finally, internal expansion methods are not well suited for use with heat exchangers formed with a serpentine tube. In contrast, external expansion methods generally cannot yield uniform tube-to-fin contact around the entire perimeter of a tube.

From the above, it can be appreciated that it would be advantageous if an improved method were available for mechanically joining the tubes and fins of a heat exchanger. Such a method would preferably result in joint strength comparable to internal expansion methods, but rely entirely on an external expansion technique so as to avoid the disadvantages of internal expansion methods, including the potential for contamination and wall thinning. A preferred technique would also be well suited for use on heat exchanger designs incorporating a serpentine tube configuration.

SUMMARY OF THE INVENTION

According to the present invention, a method is provided for assembling a heat exchanger unit that is suitable for use as a radiator for cooling a motor or engine, a condenser or evaporator for use in air conditioning systems, an oil cooler for power steering fluids, automatic and manual transmission fluids, after coolers for air and hydraulic system fluids, or a heater. The method involves a novel expansion technique that, without physical intrusion into the tube passage, produces a tube-to-fin joint that exhibits enhanced mechanical joint strength and metal-to-metal contact between the tubes and fins of a heat exchanger. Consequently, the method of this invention avoids the shortcomings of internal expansion techniques, and provides a significant improvement over prior art external expansion techniques.

The method of this invention generally includes forming a number of fins for assembly with one or more tubes having substantially parallel tube portions. Pairs of tubes portions may be connected by a bend or an elbow to yield a serpentine tube configuration. Each of the fins is formed to include one or more apertures for receiving each tube with which the fin is to be assembled. The fins are then arranged to form a fin pack, i.e., an array of substantially parallel fins, such that their apertures are aligned to form an aggregate passage through the fin pack. The tube portions are then inserted into the aggregate passage, such that the bend or elbow (if present) remains outside the fin pack. Finally, the tube portions are expanded to contact and become mechanically secured to their respective fins through the application of a force in a longitudinal direction to the tube portions. More specifically, the ends of the tube portions are fixtured and the longitudinal force applied through the fixtures, which causes the tube portions to bulge radially outward to create an interference fit between the tube portions and fins. Any brackets or other hardware intended to be joined to the tube can be simultaneously secured by the radial bulging of the tube portions.

Surprisingly, if the tubes are properly fixtured, deformation has been found to be uniform around the perimeter of each tube portion, so that a uniform interference fit is produced between each tube portion and its fins, thereby promoting heat transfer therebetween. Advantageously, the required longitudinal force can be readily controlled such that only the tube portions are deformed, with any bulging of the tube portions beyond that required to engage the fins and hardware being localized in regions of the tube portions between fins, which further promotes the structural integrity of the resulting tube-and-fin assembly. In that a compressive force is used, wall thinning does not occur in the tube portions. To the contrary, wall thickening may occur.

The above assembly method enables the insertion of the tube portions into the fin pack and the expansion of the tube portions to be performed in an uncomplicated operation. For some applications it is possible for the fixturing employed to insert a tube into a fin pack to also serve as the fixturing by which the longitudinal compressive force is applied to expand the tube. The method of this invention is greatly simplified in comparison to prior art assembly methods used to achieve comparable joint strength and integrity, such as internal expansion techniques and braze operations. Furthermore, the method of this invention can be employed to secure fins to a continuous serpentine tube, in which the tube portions and bend or elbow are part of an integrally-formed fluid passage through the fin pack, yet each tube portion is individually secured to each of the fins in the fin pack to yield a heat exchanger of high mechanical integrity. Use of a single continuous serpentine tube simplifies assembly in comparison to prior art assembled serpentine tubes that require multiple bends or elbows and connectors that must be mechanically or metallurgically joined to a number of tube portions arranged in parallel. Another advantage of the invention is that, contrary to the prior practice of using an internal expansion tool, internal tube turbulators and surface features (e.g., rifled tubes) are not destroyed by the described joining technique. Finally, the invention achieves an excellent tube-to-fin joint without the complex processing and equipment required for brazed heat exchangers.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 3:
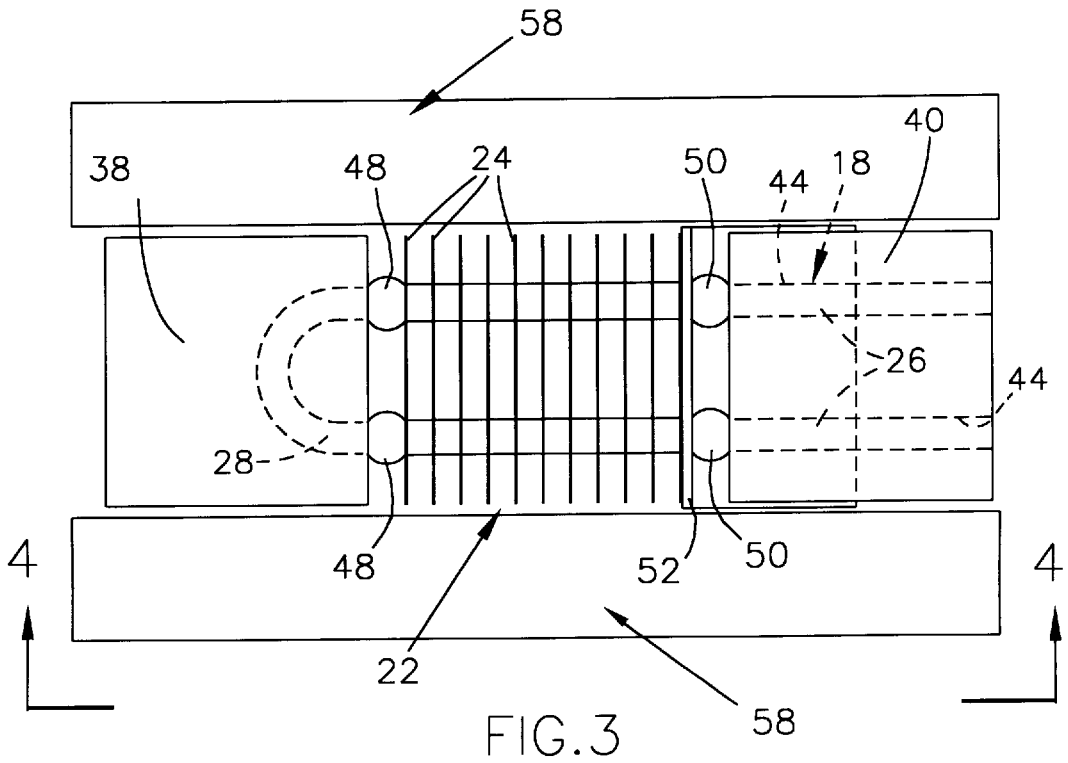
FIGS. 3 and 4 are plan and side views, respectively, of the tube-and-fin assembly of FIG. 1 following the application of a longitudinal force on the fixtures to produce radial bulges in the tubes to mechanically join the tubes and fins in accordance with this invention.
Figure 4:
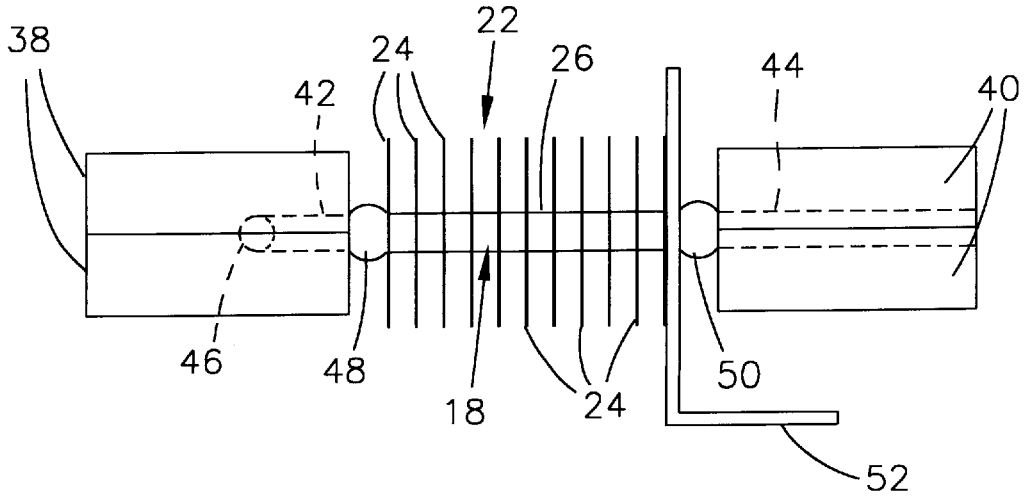
Figure 5:
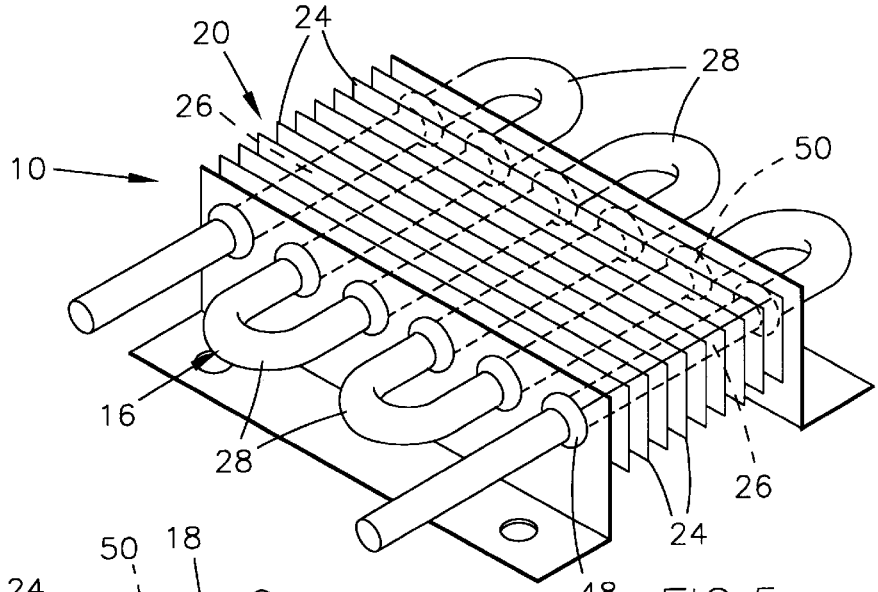
FIGS. 5, 6 and 7 are perspective views of a condenser/evaporator, automotive oil cooler and manifold-style hydraulic oil cooler, respectively, assembled by the method shown in FIGS. 1 through 4.
Figure 6:
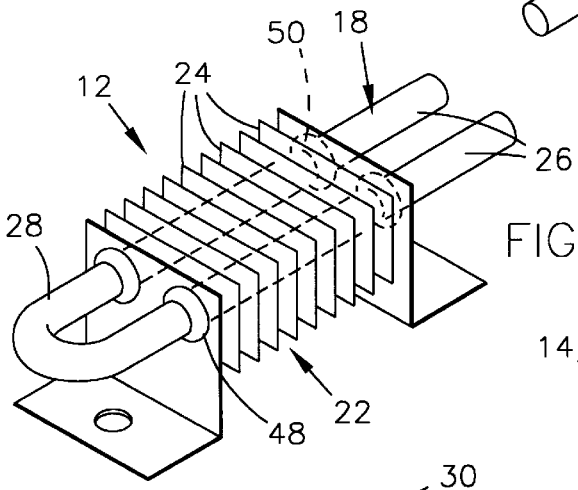
Figure 7:
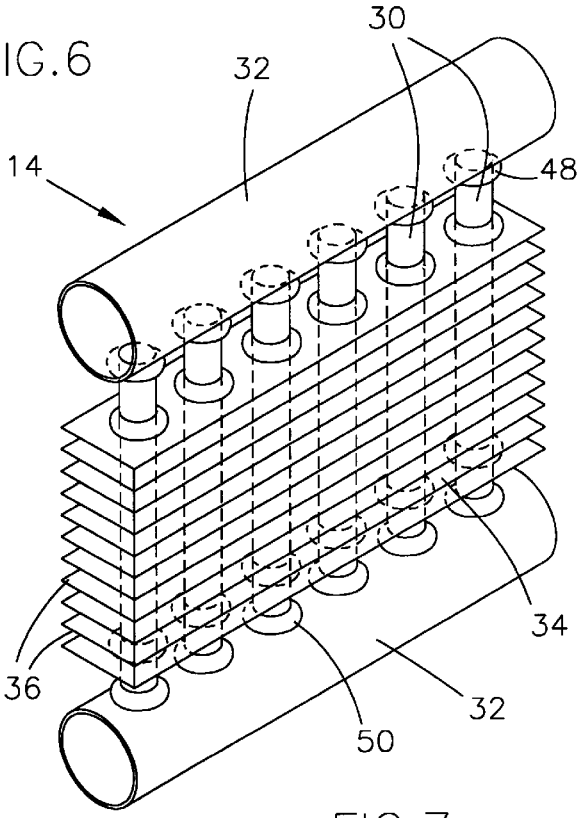

An improved method for assembling and mechanically joining tubes and fins of a heat exchanger is shown in FIGS. 1 through 4, with examples of heat exchangers 10, 12 and 14 assemblable by this method being shown in FIGS. 5 through 7, respectively. As depicted, the heat exchanger 10 is configured as a condenser or evaporator, the heat exchanger 12 is configured as an automotive oil cooler, and the heat exchanger 14 is configured as an off-road or mobile heat exchanger. The heat exchangers of FIGS. 5 and 6 are generally characterized by serpentine tubes 16 and 18, respectively, each of which is disposed within a fin pack 20 and 22, respectively, composed of a number of substantially parallel fins 24. The tubes 16 and 18 define a number of substantially parallel tube portions 26, shown as being paired together and interconnected with bends 28, although the use of elbows attached (e.g., brazed or soldered) to the ends of the tube portions 26 is also within the scope of the invention. The heat exchanger 14 of FIG. 7 is characterized by tubes 30 connected in parallel between a pair of manifolds 32. As with the heat exchangers 10 and 12 of FIGS. 5 and 6, the tubes 30 of the heat exchanger 14 shown in FIG. 7 are disposed within a fin pack 34 composed of substantially parallel fins 36. The tubes 16, 18 and 30 are each shown as having circular cross-sections, though it is foreseeable that other cross-sectional shapes could be employed. The tubes 16, 18 and 30 and the fins 24 and 36 can be formed from any suitable material, such as but not limited to copper and aluminum alloys. The tubes 16, 18 and 30 may be extrusions, with the serpentine tubes 16 and 18 subsequently formed to attain the desired serpentine shape using a suitable bending technique. The fins 24 and 36 can be formed by stamping or any other suitable technique.

While the external expansion method of this invention will be described in the context of the heat exchangers 10, 12 and 14 shown in FIGS. 5, 6 and 7, those skilled in the art will recognize that the teachings of this invention are also applicable to heat exchanger units that may differ significantly in appearance. For example, though only a single serpentine tube is shown in FIGS. 5 and 6, multiple serpentine tubes of various patterns (staggered or in-line) could be used in the construction of these heat exchanger 10 and 12. Furthermore, though the heat exchangers 10, 12 and 14 are shown as being composed of a single row of tubes, any number of tube rows and columns could be used.

FIGS. 1 through 4 depict the method and fixturing entailed in assembling and mechanically joining the serpentine tube 18 and fins 24 of the heat exchanger 12 of FIG. 6. However, the fixturing and method shown in FIGS. 1 through 4 are also applicable to the serpentine tube-and-fin assembly of FIG. 5 and the parallel tube-and-fin assembly required by the heat exchanger 14 of FIG. 7, with only minor modifications required to the fixturing for the latter. In each case, the straight portions of the tubes (the tube portions 26 of FIGS. 5 and 6 and the tubes 30 of FIG. 7) are received within apertures formed in their respective fins 24 and 36. The contour of the apertures corresponds to the cross-section of the tubes, i.e., the round tube portions 26 and tubes 30 are inserted into circular-shaped apertures of slightly larger diameter. In accordance with this invention, the apertures preferably have diameters of up to about 5% larger than the tubes received in them, though it is foreseeable that different clearances could be used. In one embodiment, a tube having a diameter of about 0.373 to about 0.375 inch (about 9.47 to about 9.53 mm) is assembled in an aperture having a diameter of about 0.375 to about 0.377 inch (about 9.53 to about 9.58 mm), for a clearance of about 0.000 to about 0.004 inch (up to about 0.1 mm).

Figure 1:
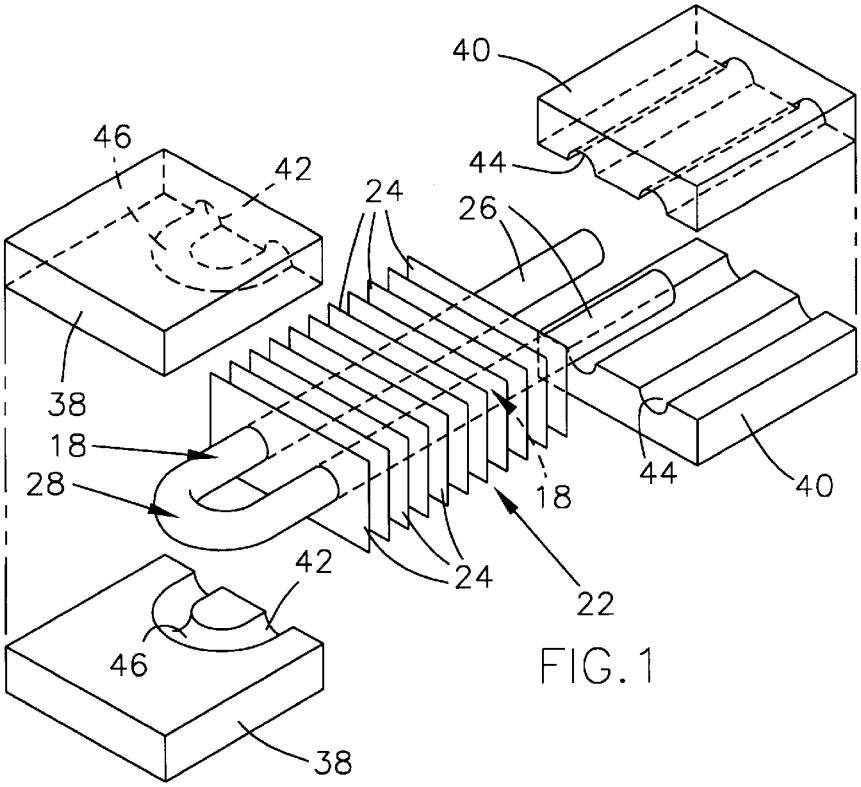
FIG. 1 is a side view of a tube-and-fin assembly for a heat exchanger unit, and fixturing for the tube ends of the assembly, prior to fixturing the tube ends in accordance with this invention.

Referring now to FIG. 1, the tube 18 and fins 24 are shown after insertion of the tube portions 26 into the apertures of the fins 24. A pair of clamping fixtures 38 and 40 are shown prior to engaging opposite ends of the tubes 18 that extend from the fin pack 22. Each fixture 38 and 40 is composed of two halves with cavities 42 and 44 in which, when the halves are clamped together, engage the adjacent end of the tube 18. The cavity 42 in the fixture 38 includes a bend 46 for receiving the bend 28 of the tube 18. In the embodiment shown in FIGS. 1 through 4, the diameter of each cavity 42 and 44 is preferably slightly smaller than the diameter of the tube 18 and the bend 28 to provide a gripping action. If only a small portion of the tube is accessible outside the fin pack, as is typically the case with heat exchangers of the type shown in FIG. 7, the cavities 42 and 44 are preferably modified to provide an abutment surface for the tube ends instead of relying on gripping the tube. Therefore, fixtures suitable for use with this invention can be configured to grip a tube, abut the tube, or a combination thereof in order to stabilize the tube while the desired longitudinal force is applied.

Figure 2:
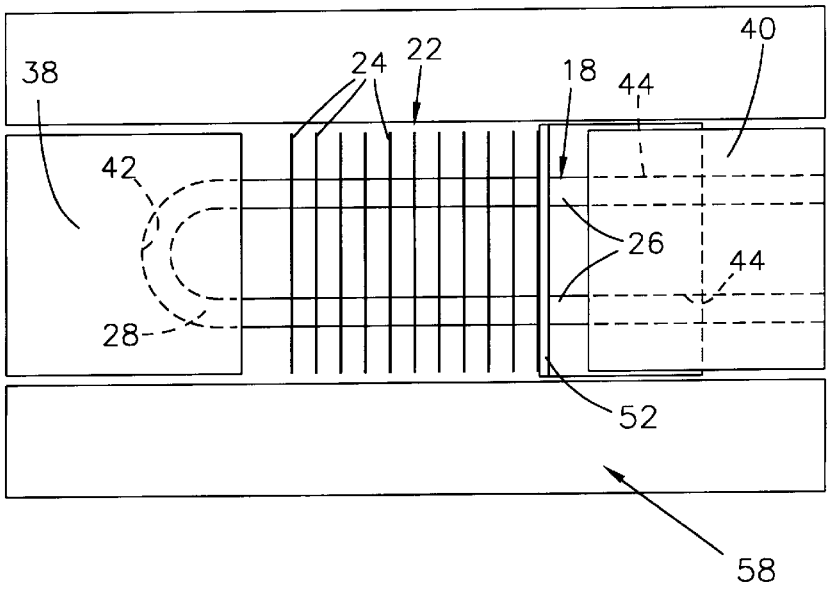
FIG. 2 is a plan view of the tube-and-fin assembly of FIG. 1 following fixturing of the tube ends.

FIG. 2 shows the fixtures 38 and 40 clamped onto the tube 18 within a suitable containment box and clamp guide 58, while FIGS. 3 and 4 show the same apparatus after the application of a longitudinal force on the fixtures 38 and 40, causing a longitudinal compression of the tube portions 26 between the fixtures 38 and 40. The result is a radial expansion of the tube portions 26 along their lengths, such that the portions 26 expand to engage and mechanically join each of the fins 24. Longitudinal compression also causes the formation of radial bulges 48 and 50 in the tube 18 between the fixtures 38 and 40 and the fin pack 22. The fins 24 limit the amount of expansion that occurs within their apertures, with further deformation producing radial bulging of the tube portions 26 between each adjacent pair fins 24. Also shown in FIG. 4 is the securement of a bracket 52 to the tube 18 by the expansion operation. While the bracket 52 is shown as being attached to tube 18 outside of the fin pack 22, the method of this invention permits securement of the bracket 52 and other hardware to the tube portions 26 within the fin pack 22.

The amount of longitudinal compression of the tube 18 to obtain reliable mechanical joining of the tube 18 and fins 24 will depend in part on the materials used and dimensions of the tube 18 and fins 24. In practice, an aluminum tube having a length of about 6.5 inches (about 16.5 cm) and a diameter of about 0.375 inch (about 9.5 mm) can be securely assembled with fins 36 having apertures sized in the range noted above by longitudinally compressing the tube about 0.375 inch (about 9.5 mm).

Figure 8:
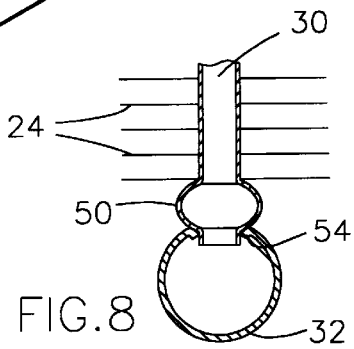
FIGS. 8 and 9 are alternative tube-and-header joints that can be produced using the method of this invention for the heat exchanger of FIG. 7.
Figure 9:
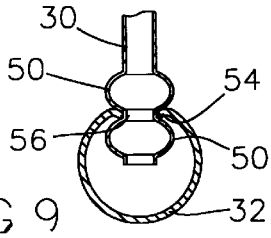

In FIG. 8, a suitable technique is shown for assembling the parallel tube-and-fin assembly of the heat exchanger 14 of FIG. 7 with the manifolds 32 following mechanical joining of the tubes 30 and fins 36 in accordance with the method of this invention. The end of one of the tubes 30 is shown as being inserted into an aperture in the manifold 32 until the bulge 50 abuts the exterior of the manifold 32. The tube 30 is then soldered to the manifold 32, creating a solder joint 54 whose resistance to leaking is promoted by the presence of the bulge 50 in the tube 30. FIG. 9 shows an alternative embodiment, in which a pair of bulges 50 are formed at the end of the tube 30, creating an annular groove 56 which receives the wall of the manifold 32 defining the aperture. Again, solder is used to complete the solder joint 54.

While the invention has been described in terms of a preferred embodiment, it is apparent that other forms could be adopted by one skilled in the art. For example, various materials could be used other than those noted, and the fixtures, tubes and fins could be configured differently from that shown yet achieve the advantages of this invention.

What is claimed is:

1. A method of assembling a heat exchanger unit, the method comprising the steps of:

forming a number of fins and at least one tube having a longitudinal tube portion, each of the fins being formed to include at least one aperture for receiving the tube portion;

arranging the fins to form a fin pack so that the apertures of the fins are coaxially aligned to form an aggregate passage through the fin pack;

inserting the tube portion into the aggregate passage such that oppositely-disposed end portions of the tube remain outside the fin pack;

fixturing the end portions of the tube; and then applying a longitudinal compressive force to the end portions of the tube to radially expand the tube portions into contact with the fins, creating an interference fit between the tube portions and the apertures so as to mechanically secure the fins to the tube portions.

2. A method as recited in claim 1, wherein the tube has a pair of longitudinal tube portions connected by a bend, and each of the fins has a pair of apertures, each of the tube portions being received in a corresponding one of the pair of apertures in each of the fins.

3. A method as recited in claim 1, wherein a plurality of tubes are formed, each of the tubes having a longitudinal tube portion, and each of the fins having a pair of apertures, each of the tube portions being received in a corresponding one of the pair of apertures in each of the fins.

4. A method as recited in claim 1, further comprising the steps of assembling a bracket to the tube portion and then securing the bracket to the tube portion when the longitudinal compressive force is applied to the end portions of the tube, so that the bracket and fins are simultaneously secured to the tube.

5. A method as recited in claim 1, wherein the applying step causes uniform deformation of the tube portion around a perimeter thereof.

6. A method as recited in claim 1, wherein the applying step causes only the tube portions to be deformed, with bulging of the tube portions beyond that required to engage the fins being localized in regions of the tube portions between fins.

7. A method as recited in claim 1, wherein the applying step causes wall thickening of the tube portions.

8. A method as recited in claim 1, wherein the applying step causes a radial bulge to form on at least a first of the end portions adjacent the fin pack.

9. A method as recited in claim 8, further comprising the steps of:

forming a manifold having a peripheral opening therein;

inserting the first of the end portions of the tube into the peripheral opening in the manifold so that the radial bulge abuts the manifold; and then soldering the tube to the manifold so that the radial bulge remains abutted against the manifold.

10. A method of assembling a heat exchanger unit, the method comprising the steps of:

forming a number of fins and at least one tube having a plurality of longitudinal tube portions, each of the fins being formed to have apertures for receiving the tube portions;

arranging the fins to form a fin pack so that the apertures of the fins are coaxially aligned to form aggregate passages through the fin pack;

inserting the tube portions into the aggregate passages such that oppositely-disposed end portions of the tube portions remain outside the fin pack;

gripping a first end portion of each of the tube portions with a first fixture assembly and gripping a second end portion of each of the tube portions with a second fixture assembly; and then applying a longitudinal compressive force to at least one of the first and second fixture assemblies to radially expand each of the tube portions into contact with the fins, creating an interference fit between the tube portions and the fins so as to mechanically secure the fins to the tube portions, and creating a radial bulge on each of the first and second end portions adjacent the fin pack.

11. A method as recited in claim 10, wherein at least one pair of the longitudinal tube portions is connected by a 180 degree bend.

12. A method as recited in claim 10, wherein the longitudinal tube portions are defined by a plurality of individual tubes, the method further comprising the steps of:

forming a pair of manifolds with each of the manifolds having peripheral openings therein;

inserting the first and second end portions of the tubes into the peripheral openings in the manifolds so that each of the radial bulges abuts one of the manifolds; and then soldering the tubes to the manifolds so that each of the radial bulges remains abutted against one of the manifolds.

13. A method as recited in claim 10, wherein the applying step causes a pair of radial bulges to form on each of the first and second end portions adjacent the fin pack, each pair of radial bulges being longitudinally spaced apart by an annular groove, the method further comprising the steps of:

forming a pair of manifolds so that each of the manifolds has an internal passage and peripheral openings;

inserting the first and second end portions of the tubes into the peripheral openings in the manifolds so that a first radial bulge of each pair of radial bulges is disposed within the internal passage of one of the manifolds and a second radial bulge of each pair of radial bulges is disposed outside of one of the manifolds; and then soldering the tube to the manifolds so that each of the first radial bulges remains disposed within one of the internal passages of the manifolds.

* * * * *